US006588640B1

(12) United States Patent
Rogers et al.

(10) Patent No.: US 6,588,640 B1
(45) Date of Patent: Jul. 8, 2003

(54) SUPPORT PLATE FOR A HOLSTER

(75) Inventors: William H. Rogers, Jacksonville, FL (US); Norman E. Clifton, Jr., Jacksonville, FL (US)

(73) Assignee: Safariland Ltd., Inc., Ontario, CA (US)

( * ) Notice: Subject to any disclaimer, the term of this patent is extended or adjusted under 35 U.S.C. 154(b) by 11 days.

(21) Appl. No.: 09/696,561

(22) Filed: Oct. 25, 2000

(51) Int. Cl.[7] ..... A45C 1/04
(52) U.S. Cl. ..... 224/673; 224/192; 224/912
(58) Field of Search ..... 224/192, 193, 224/195, 198, 677, 911, 912

(56) References Cited

U.S. PATENT DOCUMENTS 4,759,482 A * 7/1988 Olsen ..... 224/238
5,100,036 A * 3/1992 Rogers et al. ..... 224/193
5,265,781 A * 11/1993 Nichols ..... 224/197
5,551,611 A * 9/1996 Gilmore ..... 224/192
5,641,102 A * 6/1997 Hellweg ..... 224/198
5,765,738 A * 6/1998 Hoffner ..... 224/661

* cited by examiner

*Primary Examiner*—Stephen K. Cronin
(74) *Attorney, Agent, or Firm*—Arthur G. Yeager

(57) ABSTRACT

This invention relates to a back piece or a support plate for positioning a handgun holster in a substantially fixed position on a waist belt, the back piece being a molded, stiff, inflexible single thickness of leather-like material adapted to hold a holstered pistol close to the leg of the wearer with the handgun grip canted slightly outwardly for easy withdrawal and having two elongate belt slots. This invention is especially suitable for waist belts and carriers attachable to a waist belt by means of fabric hook-and-loop fasteners. A belt adapter plate is included to provide for use of the support plate with belts of smaller width and/or thickness. The support plate is constructed in a manner to deflect the lower portion of a belt outwardly so that when the belt is tensioned the lower portion of the support plate is pulled inwardly toward the leg of a wearer. The slots are formed in a manner to firmly bind against a belt when it is tensioned to fix the support plate in a desired position.

31 Claims, 8 Drawing Sheets

SUPPORT PLATE FOR A HOLSTER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the invention

This invention relates to devices to suspend personal equipment for a police officer or a soldier; and more particularly, it relates to devices that suspend article carriers such as a holster for a pistol or the like on a belt, including a waist belt.

2. Description of the Related Art

The related art includes U.S. Pat. Nos. 5,881,933, dated Mar. 16, 1999, and U.S. Pat. No. 6,010,045, dated Jan. 4, 2000. The former invention discloses a combination of two waist belts, one overlying the other, preferably locked together by "Velcro" hooks and loops, and employed for carrying sidearms and other, articles used in police work. The latter invention describes an adjustable carrier plate, which is attachable to a waist belt and provides an angular position adjustment for a gun holster or other carrier that might be attached to the belt through the plate.

U.S. Pat. No. 5,265,781, dated Nov. 30, 1993 discloses several mounting devices for holster suspension; a paddle embodiment in FIGS. 10–13 which is the more relevant embodiment to the support plate of the herein disclosed invention.

BRIEF SUMMARY OF THE INVENTION

In one aspect of the present invention there is provided a device attachable to a belt for carrying a holster including an elongate support plate having an upper portion and a lower portion and opposite side portions, and a pair of spaced elongate slots oriented lengthwise of and passing through respective side portions of the support plate. The support plate has an outer surface and an inner surface adapted to fit adjacent a wearer and includes means to deflect a belt passing through the slots, greater at a lower portion of a belt than an upper portion of a belt to cause the lower portion of the plate to be pulled against a leg of a wearer when a belt is tensioned about a wearer, the support plate further including mounting means for attachment of a holster thereto. The means to deflect includes each side portion being bent inwardly toward a wearer to shape the slot such that a passageway defined by the slot for a belt therethrough is a wedge having a wide, upper portion and a narrower lower portion for firmly grasping the inner and outer surfaces of a belt therethrough. The means to deflect in one embodiment includes the side portion adjacent the lower portion of a respective slot being thicker than the side portion adjacent the upper portion of the slot. The means to deflect in another embodiment includes an outwardly extending wall member adjacent each lower portion of a respective slot. The means to deflect in a further embodiment includes slots being slanted such the upper portions of the slots are closer together than the lower portions of the slots. The slots are substantially parallel and each is formed angularly between the surfaces so that the width of each slot adjacent the outer surface is larger than the width of the respective slot adjacent the inner surface for firmly grasping the inner and outer surfaces of a belt. The support plate is formed of a stiff, substantially inflexible material and includes mounting means having an outwardly disposed boss formed on the lower portion of the outer surface of the plate which includes at least one attachment hole formed therein for mounting a holster thereto. The slots are sized to accept belts of different widths therethrough for securing the support plate to the body of a wearer.

The support plate is curved about a vertical longitudinal axis so as to fit closely against an outside hip and leg of a wearer when a belt is worn about a waist. The lower portion of the support plate is curved at a horizontal axis so as to dispose a handgun carried in a holster attached thereto with the grip spaced away from a wearer's waist and the muzzle being closely held adjacent a leg of a wearer. Belt adapter means is include for securing to the support plate a belt having a width substantially less than the length of the slots. The belt adapter means includes an insert having opposite end portions each being disposable in a slot. The insert includes a substantially planar body positioned closely adjacent the inner surfaces of the upper portion of the support plate when the end portions are disposed in respective slots. The device may be combined with two concentric waist belts that fasten to each other by means of a fabric fastener system of hooks and loops, one belt being worn around the waist of a wearer, the other being threaded through the slots and attachable to one belt by the fastener system in a portion of the other belt that is between the slots.

In other aspects of the present invention there is provided a device attachable to a belt for carrying a holster including an elongate support plate having means for self-securing the plate on a tensioned belt to selectively fix the position of the plate along a belt and being freely movable along a belt when loosened about a wear. The means for self-securing further may include means to deflect a belt passing through the slots wherein each side portion is bent inwardly toward a wearer to shape the slot such that a passageway defined by each slot is wedge-shaped, having a wide upper portion and a narrower lower portion for firmly grasping the inner and outer surfaces of a belt therethrough. The means to deflect may have a side portion adjacent the lower portion of each slot being thicker than the side portion adjacent the upper portion of each slot. The support plate is symmetrical about a central vertical axis for use with either right-handed or left-handed holsters.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

INTRODUCTION

Figure 1:
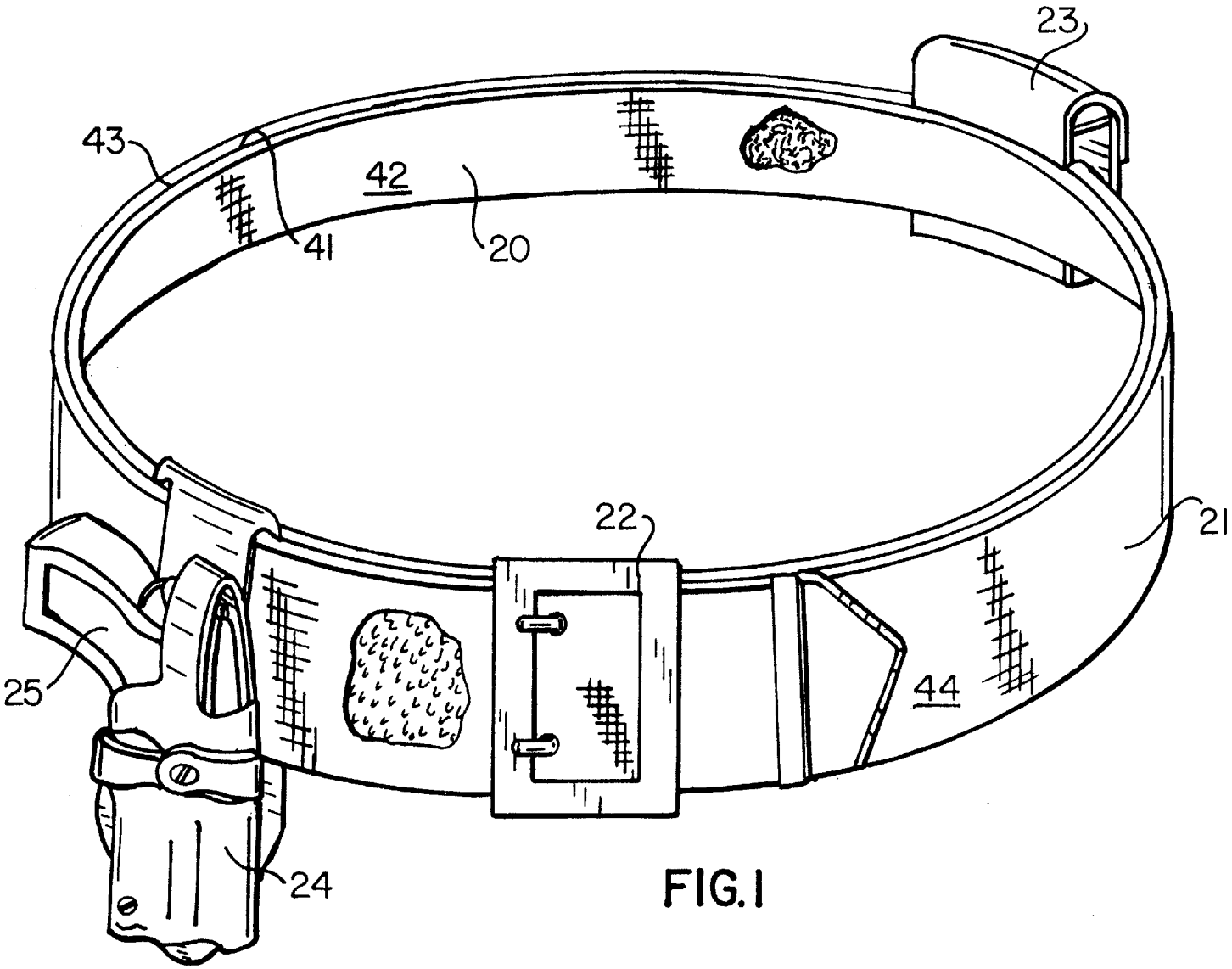
FIG. 1 is a front perspective view of a waist-encircling belt employing the support plate of the present invention as an attachment means between a pistol holster and the waist belt of the wearer.

Since the first handgun holsters, the part of the holster that was attached to the wearer's belt has had three requirements. This part of the holster, commonly referred to in the industry as the "back piece", "belt piece" or "back plate" needed to be comfortable, secure to the belt and needed to prevent the holster from riding up when the firearm is drawn quickly upward. The first holsters were actually laced to the belt with leather strips to prevent any lateral movement; Leather thongs were tied through the back piece and around the wearer's thigh to prevent the holster from riding up when drawing the firearm. The comfort issue was originally solved by wearing the handgun low on the thigh, support from the waist by a heavy piece of conforming leather.

Because of the automobile and other reasons, the modern holster must be worn high on the waist. Modern designs have proven to be uncomfortable for the most part because they are made of more rigid material. Present designs require screws, fasteners or other mechanical clamp devices to anchor the back piece to the belt. Thigh "tie down straps" are not practical with present dress standards and there have been a number of attempts by designers to improve on the ability of the holster to remain in place when drawing upward. The most recent art uses plastic or metal inserts built into the back piece and curved such that the handle of the handgun is displaced far away from the wearer's waist and the muzzle of the gun touches the wearer's leg. If the holster rides up and pivots on the belt, it can move a considerable distance before the draw is completed. Such design has come under scrutiny recently because of the officer's safety. With the grip of the weapon displaced away from the officer it is much easier for an assailant to grab the weapon.

The present invention relates to a novel back plate for a gun holster that is normally carried on a waist belt. It uses two wedge shaped parallel slots in conjunction with a concave hip-conforming radius. Because of the design of the back plate the belt is placed into a bind when the two ends of the belt are tensioned. The bottom of the belt is forced to bow outwardly on either side, i.e., the belt has a longer distance to extend around the shoulders of the slots at the bottoms compared to the tops of the slots. This binding does two things. It self locks the plate and attached handgun holster to the belt and it applies pressure to the bottom portion, or muzzle end of the holster to prevent it from riding up during the drawing motion. The weapon handle can be carried safely close to the body without compromising the draw. The present invention can be in conjunction with matching hook and loop inner and outer belts resulting in enhanced results.

This invention relates to a belt and a holster along with a novel support plate (or back plate) for carrying a pistol or a revolver suspended from a waist belt. One of the principal purposes of this combination is to keep the weapon at a specific location that is not altered by the twisting and turning of the body of the wearer in performing his or her daily duties. It is intended by wearing this combination to maintain the weapon in the same position on the waist belt so that the wearer can readily draw the weapon out of the holster when needed without fumbling around to find that the holster and weapon have inadvertently slipped around the suspension belt to a new location during the wearer's activities.

The preferred components of the combination of this invention are an inner belt 20 and an outer belt 21. Inner belt 20 may be a simple overlapping band of fabric such as canvas, generally without a buckle so as to eliminate any bulges that may interfere with the outer belt 21 and/or inhibit the arm movements of the wearer. Outer belt 21 may also be made of a fabric, or it may be made of leather to provide a more dressy appearance. Preferably belts 20 and 21 are made of materials that combine to adhere to each other and appear to be one belt. A preferred combination is to have inner belt 20 covered on the outside surface 41 with fabric loops of a "Velcro" fastener combination, while the inside surface 43 of outer belt 21 is covered with fabric hooks of a "Velcro" fastener. A typical combination of two concentric waist belts for police or military personnel is described and illustrated in the above-cited U.S. Pat. No. 5,881,933, and the disclosed general combination is basic to the present invention. The combination of belts 20 and 21 carries a holster 24 with a handgun 25. Other items are held in carrier 23 such as ammunition clips or speed loaders, handcuffs, etc. The principal component of this invention relates to the support plate 26, which serves to locate the holstered handgun 25 in a selected position along the belt 20, 21 combination; and it is this part of the equipment that will be described below.

Figure 2:
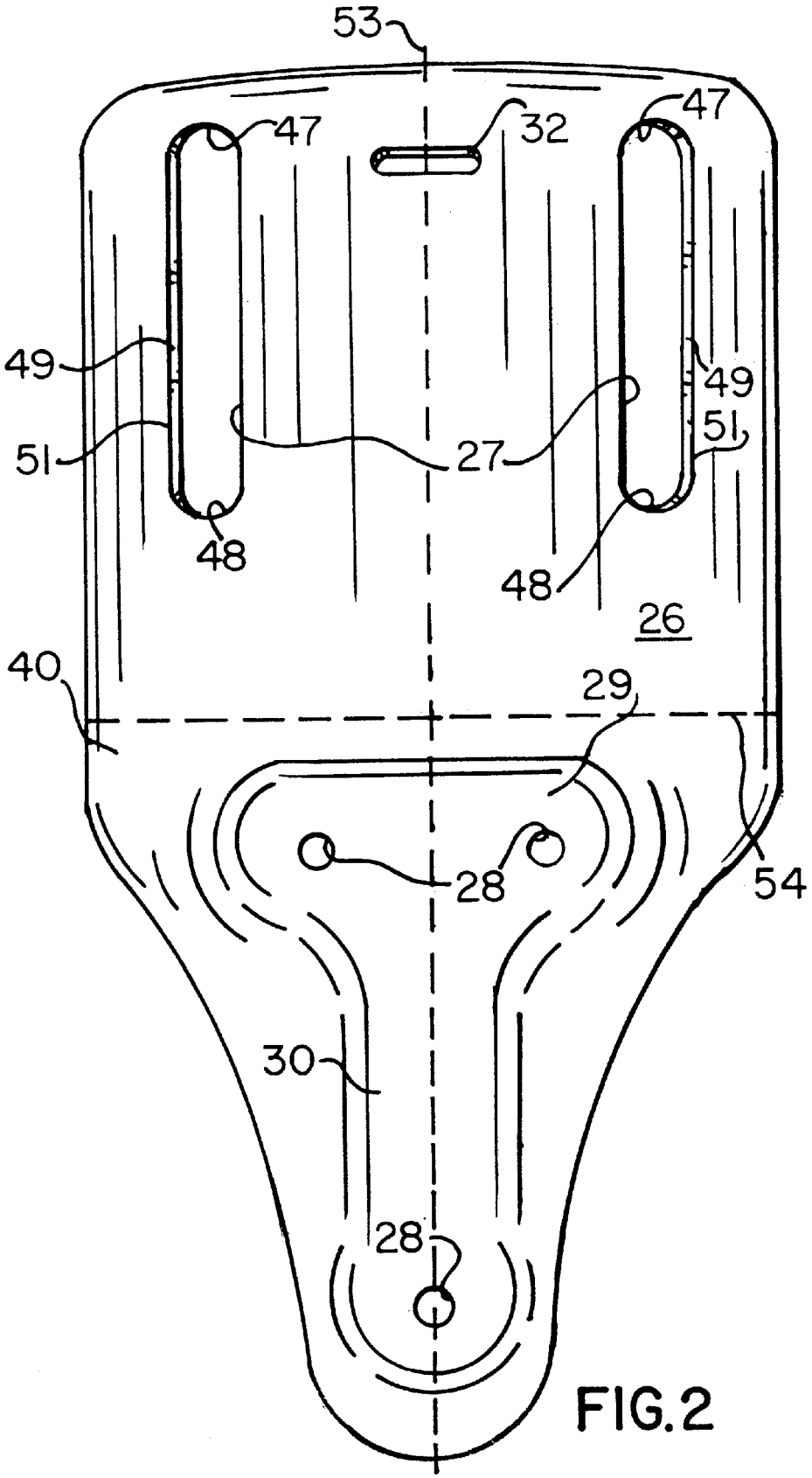
FIG. 2 is an elevational view of the support plate of the present invention showing the outer surface away from a wearer.
Figure 3:
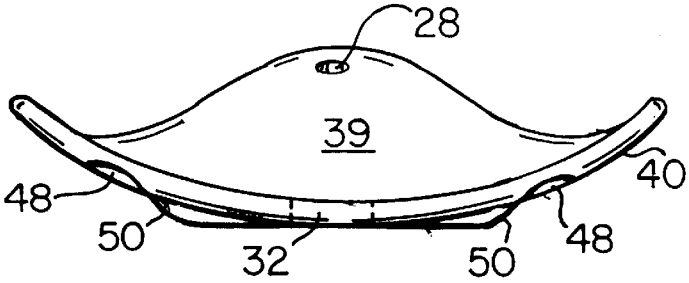
FIG. 3 is a top plan view of the support plate of FIG. 2.
Figure 4:
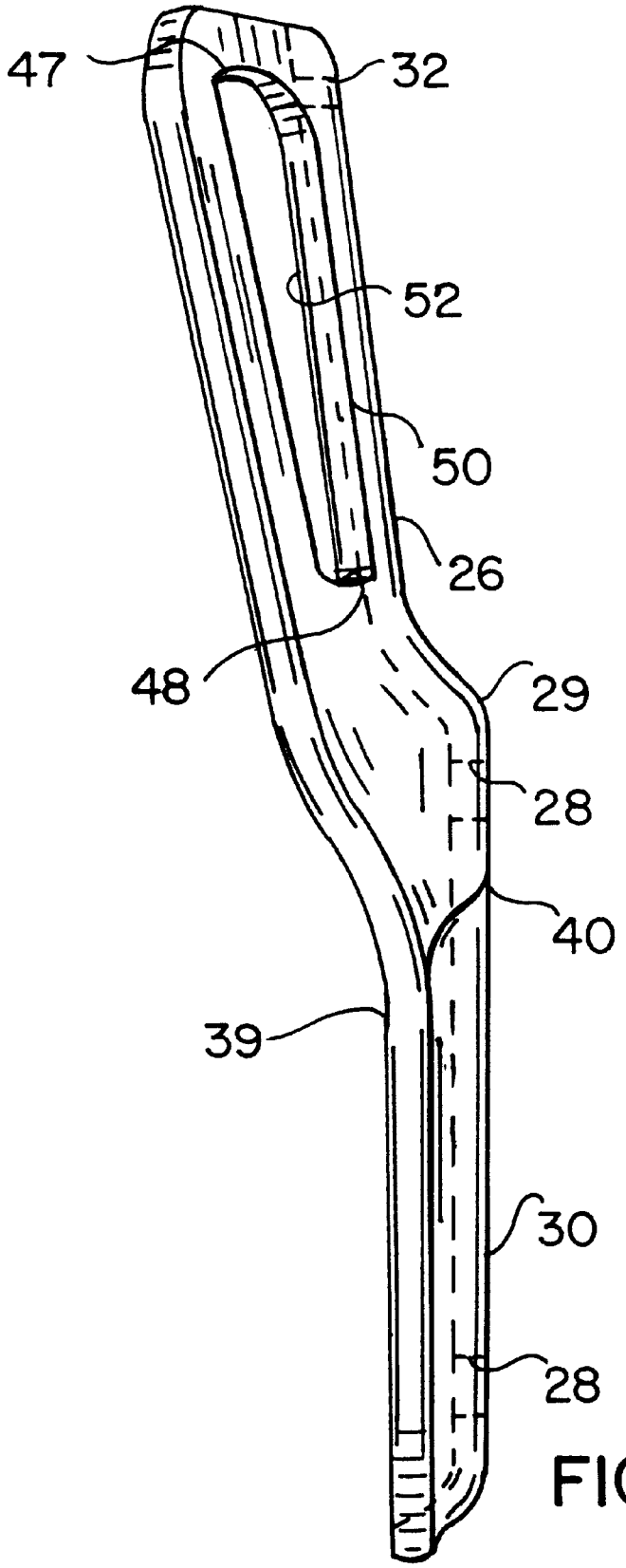
FIG. 4 is a side elevational view of the support plate of FIGS. 2 and 3.

Support plate 26 is shown in detail in FIGS. 2–4 of the attached drawings. Support plate 26 is a thin plate having a lengthwise concave inside surface 39 and a corresponding convex outer surface 40; the plate being shaped to lie closely along the upper thigh of the wearer with a holstered handgun 25 being attached to the outside surface. Plate 26 has two substantially parallel wedge-shaped slots 27 adapted to receive a waist belt therethrough. The lower central portion of plate 26 below horizontal axis 54 is curved inwardly and is shaped into a T-shaped outwardly disposed flat plateau or boss raised above the remainder of plate 26 with three spaced attachment holes 28 for attaching holster 24 to plate 26. The general shape of plate 26 allows the upper part of plate 26 to lie close to the upper thigh of the wearer with the muzzle of the handgun pointing downwardly along the leg and the handgun grip and breech of the handgun canted slightly outwardly only enough to allow immediate access by the wearer's hand for a quick withdrawal of the weapon from the holster. Among the several special characteristics of plate 26 are:

1) the concave shape of the plate 26 with compound curves provides a strong rigid structure in the horizontal and vertical directions and light weight;

2) the concave shape provides a cavity to conform around the hip bone and also conforms to the size of an adult;
3) the edges of the slots 27 are shaped so as to engage the adjoining surface of either the belts 20, 21 or 55 (FIG. 8) and thereby to prevent any lateral movement along the belt;
4) the slots 27 are widely separated so as to lessen the tendency of the plate 26 to move along the length of the belt 21 and to provide stability against rotary movement;
5) the shape of the wedge-shaped slots causes a bowing of the belts to properly position the support plate 26 as will be discussed hereinbelow;
6) the plate 26 is identical for either right-handed or left-handed wearers by virtue of being symmetrical about vertical axis 53;
7) the plate 26 is adapted to be modified by the use of a belt adapter 31 (described in detail below) for wearers who employ a narrower waist belt than the wide belt favored in the U.S.A.; and
8) the outer belt inner surface loops between the slots 27 are firmly attached to the hooks on the outer surface of the inner belt.

Figure 7:
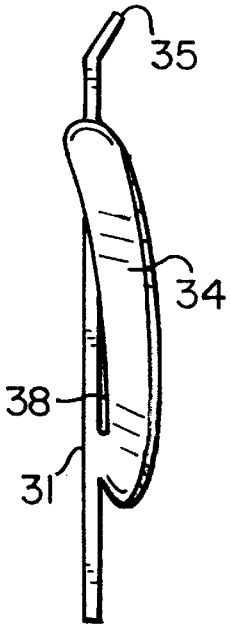
FIG. 7 is a side elevational view of the belt adapter of FIG. 6.
Figure 5:
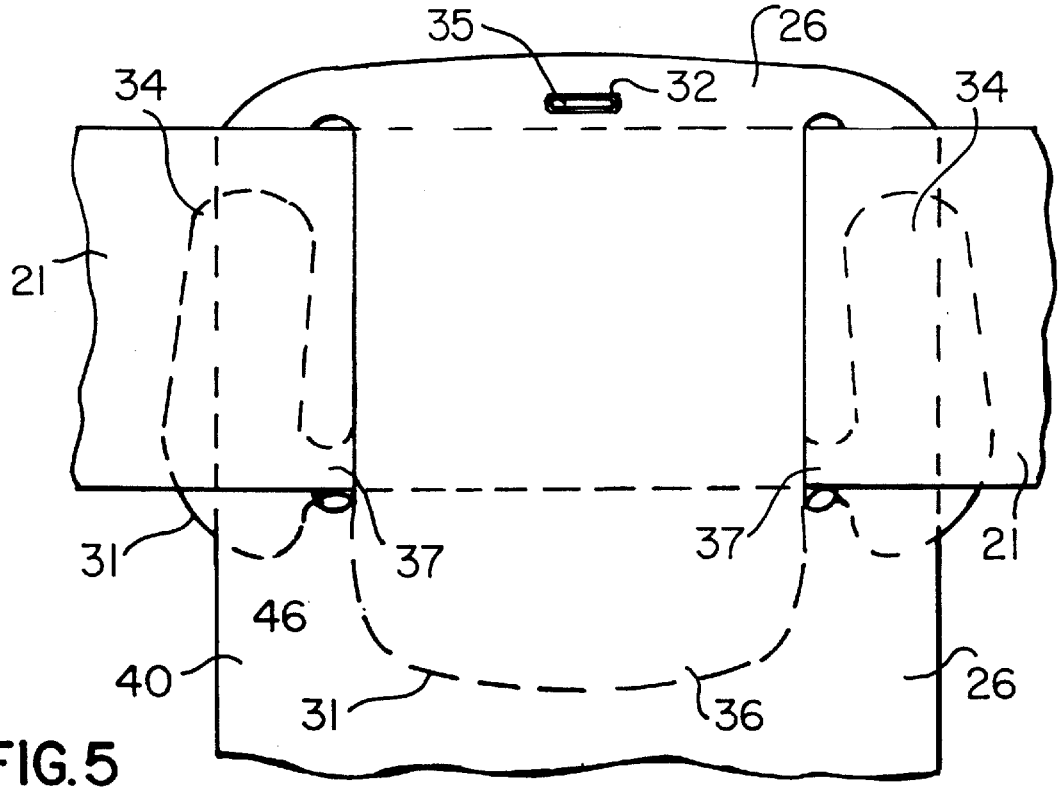
FIG. 5 is a front elevational partial view of the support plate shown in FIG. 2 modified by the presence of a belt adapter.
Figure 6:
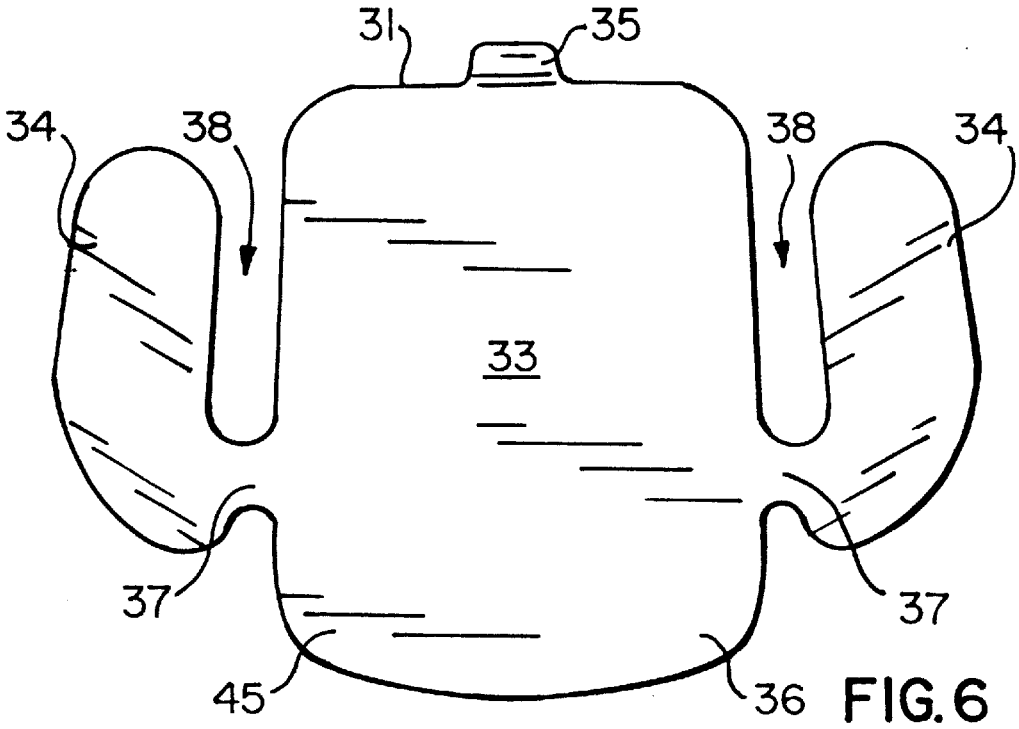
FIG. 6 is a front elevational view of the belt adapter of FIG. 5.

For the possibility that the wearer does not wish to wear a wide belt as shown in the drawing (approx. 2.0 inches in width) there is another feature of this invention involving the use of a belt adapter as illustrated in FIGS. 5–7. The adapter 31 is sandwiched between the support plate 26 and the outer belt 21. This provides a tighter fit between outer belt 21 and support plate 26 so as to permit narrower outer belts than 2.0 inches. In other countries, the outer belts of police frequently are narrower than 2.0 inches and in these situations the use of a belt adapter 31 is recommended so that substantially all of the advantages of the instant support plate may be achieved. Adapter 31 is shown in FIGS. 5–7, and the use of that adapter 31 with holster 24 is shown in FIG. 5. Belt adapter 31 is a partially flat piece of plastic as seen in FIG. 6. Adapter 31 includes a rectangular central body 33 having inner surface 45 and outer surface 46 with two oppositely positioned flexible side wings 34 each joined to body 33 by a narrow neck 37 that defines spacer slots 38. At the top of the body 33 there is a tongue 35 designed to penetrate into slot 32 at the top of support plate 26.

With respect to FIGS. 5 and 6, adapter 31 lies flat between the outer surface 44 of outside belt 21 and the inside surface 39 of support plate 26. Thus, a sandwich construction results of these three components is produced with adapter 31 being the middle layer, support plate 26 being the outside layer, and belt 21 being the inner layer. Tongue 35 is inserted into slot 32. Wings 34 are spread outwardly so that belt slots 27 and spacer slots 38 are aligned. Belt 21 is then threaded into one belt slot 27 and through aligned spacer slot 38 in adapter 31 and thence across the back of adapter 31 to emerge through the other slot 38 and belt slot 27 as shown.

Each slot 37 includes a top portion 47, a bottom portion 48, an outward side 49 and an inward side 50. When belt 21 is threaded through the support plate 26 the belt 21 is engaged by the innermost edge 52 of side 50 and the outermost edge 51 of side 49 of the respective slots 47.

As seen in FIG. 4, the belt passageway is wedge-shaped with a top that is wider than the bottom. This structure is provided by the bending of the sides of the support plate 26 that contain slots 27 inwardly toward the wearer and provides for inward movement of the lower portion of the support plate 26 and an attached holster 24. This arrangement produces a tight fit for adapter 31, support plate 26, and outer belt 21 to inhibit slippage of holster 24 along the length of belt 21.

Figure 8:
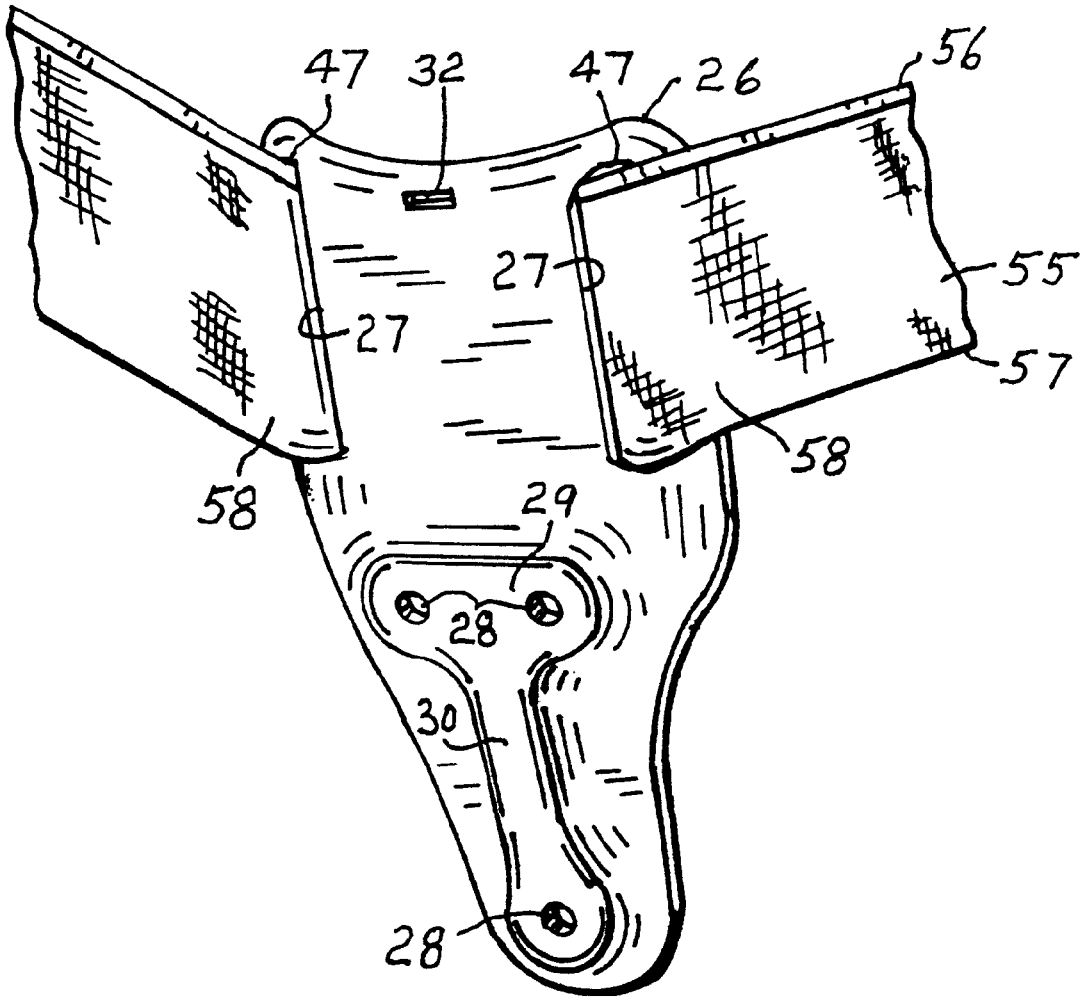
FIG. 8 is a perspective view of the support plate of FIG. 1 showing an alternate belt mounted therethrough.
Figure 9:
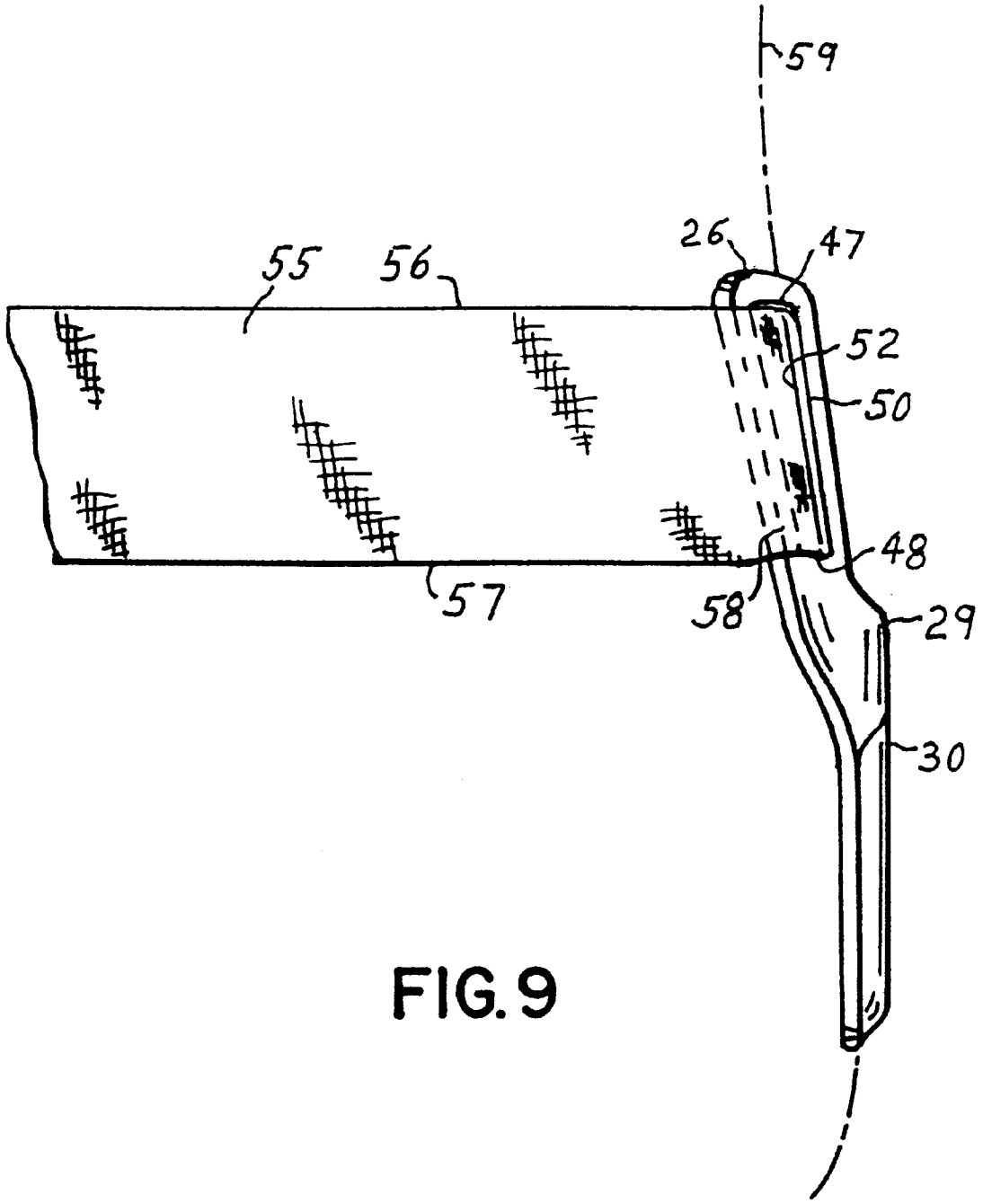
FIG. 9 is a perspective view of the support plate of FIG. 8.

With respect to FIG. 8, the support plate 26 is shown with a portion of a standard police belt 55 having an upper portion 56 and a lower portion 57. As belt 55 is threaded through slots 27 the lower portion 57 will distort in an outward arch or bow due to the narrow lower portion 48 of the belt 55 will remain straight as it passes from one slot 27 to another. The belt is quite stiff as understood in the art and therefore an outward arch or bulge portion 58 will be created because the belt 55 is too thick to fit through both of the lower portions 48 of the slots 29 and remain flat as is the case with the top portion 56 of the belt as can be seen from the side view of FIGS. 4 and 9. When the belt 55 is tensioned to secure it around the waist of a wearer 59 and inwardly directed force will push the lower portion of the support plate 26 below axis 54 inwardly against the body of the wearer 59. At this position the arch or bulge portions 58 will become only slightly smaller thus maintaining inward force on the lower portion of support plate 26. The force of the bowed belt 55 against the support plate 26 will cause a binding therebetween holding it in position.

Figure 10:
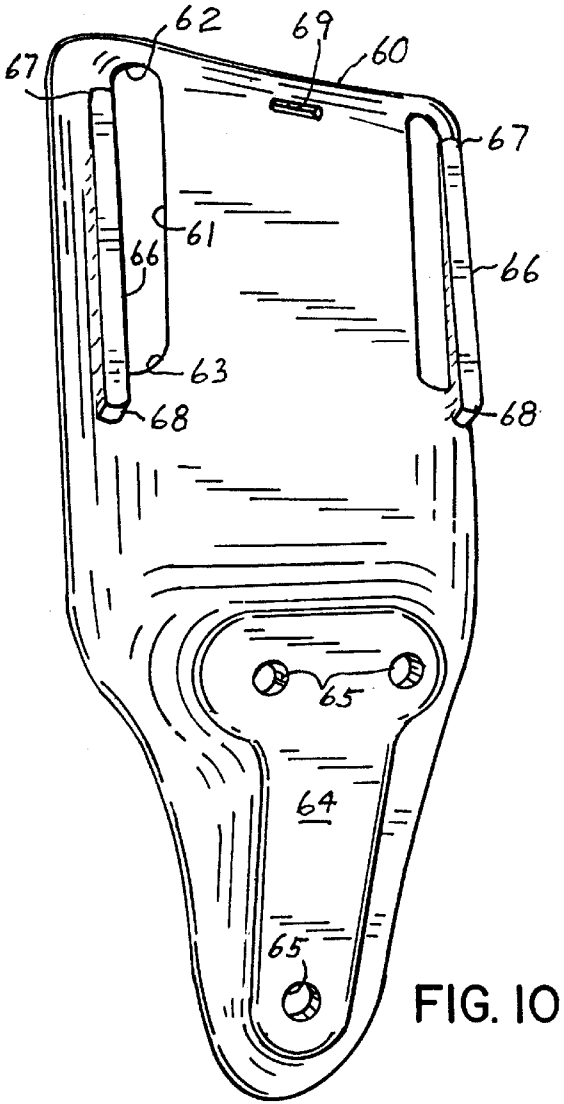
FIG. 10 is a perspective view of another embodiment of the support plate in accord with the present invention.

With respect to FIG. 10, an alternative support plate 60 is illustrated. Slots 61 have an upper end portion 62 and a lower end portion 63. An upraised wall is formed of wedge member 66 formed integrally with the body of support plate 60. The member 66 preferably includes a thin upper portion 67 and a thicker lower portion 68 in the form of an upraised wall extending outwardly. Mounting hole 69 is used for belt adapter 31. The wedges 66 are illustrated as having sharp edges but they can be formed rounded if so desired. Mounting portion 64 and mounting holes 65 are the same functionally as those of support plate 26.

The wedge members 66 provide for the same arch or outward bowing of the bottom portion 57 of a belt 55, as do the wedge-shaped slots discussed hereinabove. When a belt 55 is tightened by a wearer 59 the support plate 60 is substantially fixed in position along the belt 55 because of the binding action between the slots 61 and adjacent wedges 66 and the distorted arch portion of the belt 55 adjacent thereto. The upraised thick portion 68 can be used without upper thin portion 67.

Figure 11:
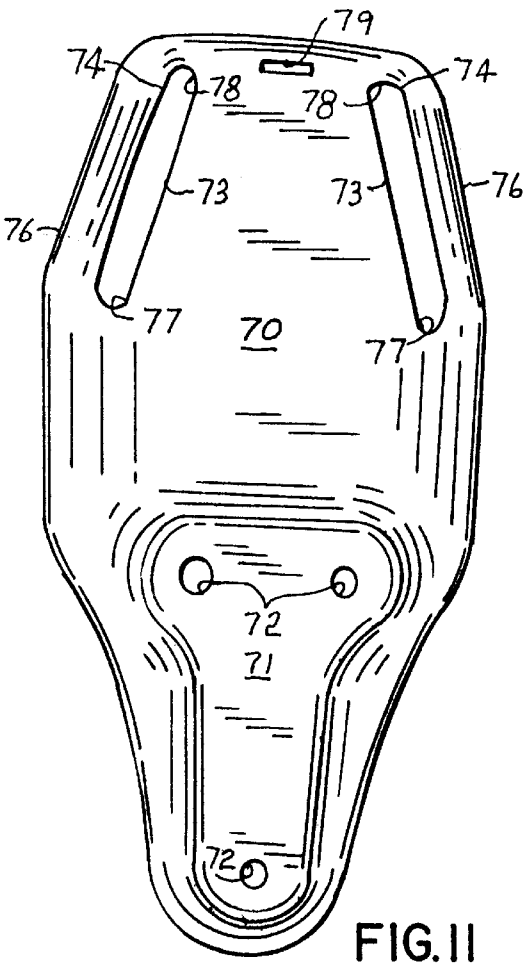
FIG. 11 is a front perspective view of another embodiment of the support plate in accord with the present invention.

In FIG. 11 another embodiment of the support plate according to the present invention is shown at 70. The support plate 70 has an upraised mounting portion 71 and three screw holes 72 as before. Slots 73 are formed to be slanted from the vertical to place upper portions 78 closer together than lower portions 77 as are sides 76 of the support plate 70. Outward walls 74 of slots 73 assist in providing the binding or gripping action as discussed hereinabove. A belt 55 threaded through slots 73 in the manner of FIG. 8 will lie flat along the top portion 56 adjacent upper portion 78 but will also arch outwardly near a slot 73 as it passes over the portion of the support plate 70 at the lower portion 77 due to the curvature of the upper portion of the support plate 70. Accordingly, lower portion 77 is displaced laterally outwardly further away from a wearer 59 than upper portion 78. Mounting hole 79 is used with belt adapter 31.

In each of the support plates 26, 60, and 70, the lower portion of the respective slots 27, 61, and 73 are formed to require the bottom portion of a stiff belt 55 to bend outwardly away from a wearer before going through the respective slot and then across the inside of the respective support plate, and then outward through the opposite slot with an additional outward bend. From there the bottom portion 57 of the belt 55 curves outwardly over the support and inwardly against the body of wearer 59. When the belt 55 is tensioned around the user 59 the force on the lower portion 57 of belt 55 works against the bends resulting in a movement of the lower portion of the respective support plate inwardly against the body of wearer 59. The top portion 56 of belt 55 undergoes virtually no outward bending when it is threaded through the slots in a respective support plate. The binding action of the slots and the respective edges thereof results in the support plate being fixed in position as long as the belt remains tensioned.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by letters patent of the united states is:

1. A device attachable to a belt for carrying a holster comprising a stiff, substantially inflexible elongate support plate having an upper portion and a lower portion and opposite side portions, a pair of spaced elongate slots oriented lengthwise and in the same direction as the elongation of said elongate support plate and passing through respective said side portions of said support plate, said plate including means to deflect a belt passing through said slots, greater at a lower portion of a belt than an upper portion of a belt to cause said lower portion of said plate to be pulled against a leg of a wearer when a belt is tensioned about a wearer, said support plate further including mounting means located in said lower portion for attachment of a holster thereto.

2. The device as defined in claim 1 wherein said means to deflect includes each said side portion being formed inwardly toward a wearer to shape said slot such that a passageway defined by said slot for a belt therethrough is a wedge having a wide upper portion and a narrower lower portion for firmly grasping the inner and outer surface of a belt therethrough.

3. The device as defined in claim 1 wherein said means to deflect includes said side portion adjacent said lower portion of a respective said slot being thicker than said side portion adjacent said upper portion of said slot.

4. The device as defined in claim 1 wherein said means to deflect includes an outwardly extending wall member adjacent each said lower portion of a respective said slot.

5. The device as defined in claim 1 wherein said means to deflect includes said slots being slanted such that the upper portions of said slots are closer together than said lower portions of said slots.

6. The device as defined in claim 1 wherein said slots are substantially parallel.

7. The device as defined in claim 1 wherein said plate includes an inner and an outer surface, each said slot being formed angularly between said inner and outer surfaces so that the width of each said slot adjacent said outer surface is larger than the width of said respective slot adjacent said inner surface for firmly grasping the inner and outer surfaces of a belt.

8. The device of claim 1 wherein said means to deflect includes means for self-securing said plate on a tensioned belt to selectively fix the position of said plate along a belt whereby said plate is immovable, said plate being freely movable along a belt when loosened about a wearer.

9. The device as defined in claim 1 wherein said mounting means includes an outwardly disposed boss formed on said lower portion of said outer surface of said plate, said boss further including at least one attachment hole formed therein for mounting a holster thereto.

10. The device as defined in claim 1 wherein said slots are sized to accept belts of different widths therethrough for securing said support plate to the body of a wearer.

11. The device as defined in claim 1 wherein said support plate is curved about a vertical longitudinal axis so as to fit closely against an outside hip and leg of a wearer when a belt is worn about a waist.

12. The device as defined in claim 1 wherein said lower portion of said support plate is curved at a horizontal axis so as to dispose a handgun carried in a holster attached thereto with the grip spaced away from a wearer's waist and the muzzle being closely held adjacent a leg of a wearer.

13. The device as defined in claim 1 further including belt adapter means for tightly securing to said support plate a belt having a width substantially less than the length of said slots.

14. The device as defined in claim 13 wherein said belt adapter means includes an insert having opposite end portions, each said end portion being disposable in a said slot.

15. The device as defined in claim 14 wherein said insert includes a substantially planar body positioned closely adjacent said inner surfaces of said upper portion of said support plate when said end portions are disposed in respective said slot.

16. The combination of the support plate of claim 1 with two concentric waist belts that fasten to each other by means of a fabric fastener system of hooks and loops, one said belt being worn around the waist of a wearer, the other said belt being threaded through said slots and attachable to said one belt by said fastener system in a portion of said other belt that is between said slots.

17. A device attachable to a belt for carrying a holster comprising a stiff, substantially inflexible elongate support plate having an upper portion and a lower portion and opposite side portions, a pair of spaced elongate slots oriented lengthwise and in the same direction as the elongation of said elongate support plate and passing through respective said side portions of said support plate, said support plate having an outer surface and an inner surface adapted to fit adjacent a wearer, said plate including means for self-securing said plate on a tensioned belt to selectively fix the position of said plate along a belt, said plate being freely movable along a belt when loosened about a wearer, said support plate further including mounting means located in said lower portion for attachment of a holster thereto.

18. The device as defined in claim 17 wherein said means for self-securing further includes means to deflect a belt passing through said slots, said means to deflect including said side portions, each said side portion being formed inwardly toward a wearer to shape respective said slot such that a passageway defined by each said slot is wedge shaped having a wide upper portion and a narrower lower portion for firmly grasping the inner and outer surfaces of a belt therethrough.

19. The device as defined in claim 17 wherein said means for self-securing further includes means to deflect a belt passing through said slots, said means to deflect including said side portion adjacent said lower portion of said slot being thicker than said side portion adjacent said upper portion of said slot.

20. The device as defined in claim 17 wherein said support plate is symmetrical about a central vertical axis for use with either right-handed or left-handed holsters.

21. The device as defined in claim 17 wherein said mounting means includes an outwardly disposed boss formed on said lower of said outer surface of said plate, said boss further including a plurality of attachment holes formed therein for mounting a holster thereto.

22. The device as defined in claim 17 wherein said lower portion of said support plate is curved at a horizontal axis so as to dispose a handgun carried in a holster attached thereto with the grip spaced away from a wearer's waist and the muzzle being closely held adjacent a leg of a wearer.

23. The device as defined in claim 17 wherein said support plate is curved about a vertical longitudinal axis so as to fit closely against an outside hip and leg of a wearer when a belt is worn about a waist.

24. The device as defined in claim 17 further including belt adapter means for tightly securing to said support plate a belt having a width substantially less than the length of said slots.

25. The device as defined in claim 24 wherein said belt adapter means includes an insert having opposite end portions, each said end portion being disposable in a said slot.

26. The device as defined in claim 25 wherein said insert includes a substantially planar body positioned closely adjacent said inner surface of said upper portion of said support plate when said end portions are disposed in respective said slots.

27. The combination of the support plate of claim 17 with two concentric waist belts that fasten to each other by means of a fabric fastener system of hooks and loops, one said belt being worn around the waist of a wearer, the other said belt being threaded through said slots and attachable to said one belt by said fastener system in a portion of said other belt that is between said slots.

28. The device as defined in claim 17 wherein said means to deflect includes an outwardly extending wall member adjacent each said lower portion of a respective said slot.

29. The device as defined in claim 17 wherein said means to deflect includes said slots being slanted such that the upper portions of said slots are closer together than said lower portions of said slots.

30. The device as defined in claim 17 wherein said slots are substantially parallel.

31. The device as defined in claim 17 where each said slot is formed angularly between said surfaces so that the width of each said slot adjacent said outer surface is larger than the width of said respective said slot adjacent said inner surface for firmly grasping the inner and outer surfaces of a belt.

* * * * *